US005314643A

United States Patent [19]

Edmondson et al.

[11] Patent Number: 5,314,643

[45] Date of Patent: May 24, 1994

[54] HIGH TEMPERATURE CORROSION INHIBITOR

[75] Inventors: James G. Edmondson, Conroe; S. Blake Pruett, Montgomery, both of Tex.

[73] Assignee: Betz Laboratories, Inc., Trevose, Pa.

[21] Appl. No.: 38,431

[22] Filed: Mar. 29, 1993

[51] Int. Cl.[5] ..... C23F 11/16

[52] U.S. Cl. ..... 252/389.23; 252/389.24; 252/389.61; 422/12; 422/15; 208/47

[58] Field of Search ..... 208/47; 252/389.24, 252/400.2, 395, 406, 389.23, 389.61; 422/12, 15

[56] References Cited

U.S. PATENT DOCUMENTS

| | | | |
|---|---|---|---|
| 2,785,128 | 3/1957 | Popkin | 252/32.7 E X |
| 2,916,454 | 12/1959 | Bradley et al. | 252/42.7 |
| 3,105,810 | 10/1963 | Miller | 208/48 AA |
| 3,271,295 | 9/1966 | Gonzalez | 208/48 AA |
| 3,437,585 | 4/1969 | Kuchar | 208/96 |
| 3,442,791 | 5/1969 | Gonzalez | 208/48 AA |
| 3,489,682 | 1/1970 | Lesuer | 252/400.1 |
| 3,567,623 | 3/1971 | Hagney | 208/48 AA |
| 3,583,920 | 6/1971 | Furby et al. | 252/389.2 X |
| 3,679,587 | 7/1972 | Smith | 252/389.2 |
| 3,776,835 | 12/1973 | Dvoracek | 208/48 AA |
| 4,024,048 | 5/1977 | Shell et al. | 208/48 AA |
| 4,024,049 | 5/1977 | Shell et al. | 208/48 AA |
| 4,024,051 | 5/1977 | Shell et al. | 208/48 AA X |
| 4,105,540 | 8/1978 | Weinland | 585/650 |
| 4,107,030 | 8/1978 | Slovinsky et al. | 208/48 AA |
| 4,123,369 | 10/1978 | Miller et al. | 252/389.22 |
| 4,542,253 | 9/1985 | Kaplan | 585/650 |
| 4,556,476 | 12/1985 | Miler et al. | 208/58 AA |
| 4,578,178 | 3/1986 | Forester | 208/48 AA |
| 4,619,756 | 10/1986 | Dickakian | 208/48 AA |
| 4,828,674 | 5/1989 | Forester | 208/48 AA |
| 4,927,519 | 5/1990 | Forester | 208/48 AA |
| 4,941,994 | 7/1990 | Zetlmeisl et al. | 252/389.23 |
| 5,182,013 | 1/1993 | Petersen et al. | 208/348 |

*Primary Examiner*—Robert L. Stoll
*Assistant Examiner*—Valerie Fee
*Attorney, Agent, or Firm*—Alexander D. Ricci; Gregory M. Hill

[57] ABSTRACT

A process for the inhibition of corrosion caused by naphthenic acid and sulfur compounds during the elevated temperature processing of crude oil by use of a corrosion inhibitor consisting of trialkylphosphate and an alkaline earth metal phosphonate-phenate sulfide.

8 Claims, No Drawings

HIGH TEMPERATURE CORROSION INHIBITOR

FIELD OF THE INVENTION

This invention relates generally to a process for inhibiting corrosion in refining operations. It is specifically directed toward the inhibition of corrosion caused by naphthenic acids and sulfur compounds which are present in the crude oil.

BACKGROUND OF THE INVENTION

Corrosion problems in petroleum refining operations associated with naphthenic acid constituents in crude oils have been recognized for many years. Such corrosion is particularly severe in atmospheric and vacuum distillation units at temperatures between 400 degrees F. and 790 degrees F. Other factors that contribute to the corrosivity of crudes containing naphthenic acids include the amount of naphthenic acid present, the concentration of sulfur compounds, the velocity and turbulence of the flow stream in the units, and the location in the unit (e.g., liquid vapor interface).

In the distillation refining of crude oils, the crude oil is passed successively through a furnace, and one or more fractionators such as an atmospheric tower and a vacuum tower. In most operations, naphthenic acid corrosion is not a problem at temperatures below about 400 degrees F. Traditional nitrogen-based filming corrosion inhibitors are not effective at these high temperatures and the other approaches for preventing naphthenic acid/sulfur corrosion such as neutralization present operational problems or are not effective.

It should be observed that the term "naphthenic acid" includes mono and di basic carboxylic acids and generally constitutes about 50 percent by weight of the total acidic components in crude oil. Naphthenic acids may be represented by the following formula:

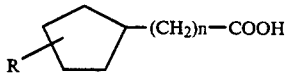

where R is an alkyl or cycloalkyl and n ranges generally from 2 to 10.

Many variations of this structure and molecular weight are possible. Some practitioners include alkyl organic acids within the class of naphthenic acids.

Naphthenic acids are corrosive between the range of about 210 degrees C. (400 degrees F.) to 420 degrees C. (790 degrees F.). At the higher temperatures the naphthenic acids are in the vapor phase and at the lower temperatures the corrosion rate is not serious. The corrosivity of naphthenic acids appears to be exceptionally serious in the Presence of sulfide compounds, such as hydrogen sulfur.

Efforts to minimize or prevent the naphthenic acid/-sulfur corrosion have included the following approaches:

(a) blending of higher naphthenic acid content oil with oil low in naphthenic acids;

(b) neutralization and removal of naphthenic acids from the oil; and (c) use of corrosion inhibitors.

Because these approaches have not been entirely satisfactory, the accepted approach in the industry is to construct the distillation unit, or the portions exposed to naphthenic acid/sulfur corrosion, with resistant metals such as high quality stainless steel or alloys containing higher amounts of chromium and molybdenum. However, in units not so constructed there is a need to provide inhibition treatment against this type of corrosion. The prior art corrosion inhibitors for naphthenic acid environments include nitrogen based filming corrosion inhibitors. However, these corrosion inhibitors are relatively ineffective in the high temperature environment of naphthenic acid oils.

DETAILED DESCRIPTION OF THE INVENTION

It has been discovered that the combination of a trialkylphosphate and an alkaline earth metal phosphonate-phenate sulfide function effectively as an inhibitor of naphthenic acid/sulfur corrosion on the internal metallic surfaces of the equipment used in crude oil refining operations.

The trialkylphosphate/alkaline earth metal phosphonate-phenate sulfide inhibitor will consist of a ratio, by weight, of from about 1/10 to 2/1. The preferred ratio range will be from about 1/5 to 1/1.

The alkaline earth metal phosphonate-phenate sulfide compounds suitable for this invention are produced from alkylphenol sulfides of the class represented by the general formula:

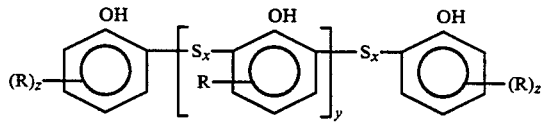

wherein R represents an alkyl radical having from about 5 to about 24 carbon atoms, x represents an integer from 1 to 4, y represents an integer from 0 to 9 and z represents an integer from 1 to 5.

As is well known, the various alkyl phenol sulfides coming within the aforesaid formula may be prepared by reaction of the various alkyl phenols with either sulfur monochloride or sulfur dichloride in various proportions. In these reactions the proportions of alkyl phenol and sulfur chloride used affects the type of product produced. The following are illustrative of the types of products which may be obtained using sulfur dichloride: (1) a product prepared by the reaction of 4 mols of a monoalkyl-substituted phenol with 3 mols Of sulfur dichloride:

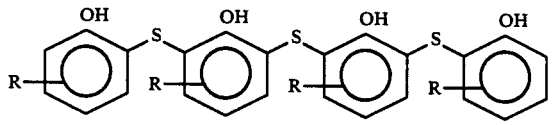

where R represents an alkyl radical.

(2) A product prepared from 2 mols of an alkyl phenol substituted with one or more alkyl groups with 1 mol of sulfur dichloride:

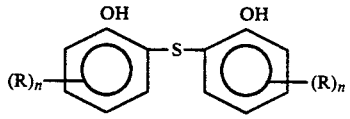

where R represents an alkyl radical and n is an integer from 1 to 4.

(3) A product prepared from an alkyl phenol with sulfur dichloride in a 1:1 mol ratio:

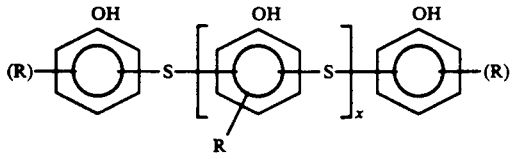

where R represents an alkyl radical and x is an integer of 2 to about 6. These products are usually referred to as phenol sulfide polymers.

It will be understood that although the types of compounds above-illustrated represent the principal phenol sulfide products provided by reacting the proportions of alkyl phenol and sulfur dichloride specified, the products in all cases are actually mixtures of various phenol sulfides containing at least small amounts of di- and polysulfides, such as the following:

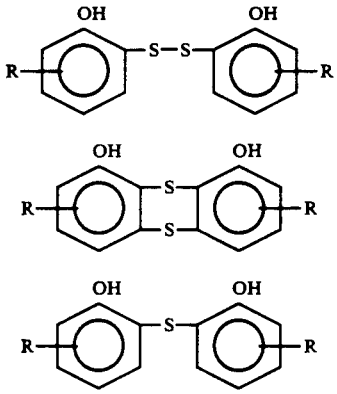

where R is alkyl.

As ordinarily manufactured on a commercial basis the phenol sulfides are prepared from mixtures of alkyl phenols and not from pure compounds. It will be understood then that the present invention has application to phenol sulfides in general, including specific relatively pure alkyl phenols as well as mixtures thereof.

A portion of the phenol hydroxyl groups in these alkyl phenol sulfides is esterified with phosphoric acid to produce a phosphonate, and the partially phosphonated material is then reacted with the oxides or hydroxides of an alkaline earth metal to produce the phenate compounds. The preferred alkaline earth metal alkyl phosphonate-phenate sulfides useful in this invention are slightly overbased calcium phosphonate-phenate sulfides. An example of such a product has the following typical characteristics.

| Appearance | Dark yellow-brown viscous liquid | |
|---|---|---|
| | Min. | Typical |
| Calcium % (wt) | 1.55 | 1.65 |
| Phosphorus, % (wt) | 0.9 | 1.03 |
| Sulfur % (wt) | 2.4 | 3.2 |
| Specific Gravity at 60/60° F. | | 0.94 |
| Viscosity at 210° F., ca | | 45 |
| Total Base Number | | 50 |

In general, the preferred alkaline earth metal phosphonate-phenate sulfides useful in this invention are those in which from 20–40 percent of the phenol hydroxy groups have been phosphonated. A portion of the phosphoric acid treated phenolic functionality may not be converted to phosphonate, but may remain as a phosphate ester.

The trialkylphosphate will contain an alkyl moiety of $C_1$–$C_{12}$ such that those compounds contemplated as having the desired efficacy and within the disclosure of the present invention include trimethylphosphate, triethylphosphate, tripropylphosphate, tributylphosphate and tripentylphosphate. Due to its easy commercial availability, tributylphosphate may be considered the preferred compound.

The most effective amount of the corrosion inhibitor to be used in accordance with this invention can vary, depending on the local operating conditions and the particular hydrocarbon being processed. Thus, the temperature and other characteristics of the acid corrosion system can have a bearing on the amount of the inhibitor or mixture of inhibitors to be used. Generally, where the operating temperatures and/or the acid concentrations are higher, a proportionately higher amount of the corrosion inhibitor will be required. It has been found that the concentration of the corrosion inhibitors or mixture of inhibitors added to the crude oil may range from about 1 ppm to 5000 ppm. It has also been found that it is preferred to add the inhibitors at a relatively high initial dosage rate of 2000–3000 ppm and to maintain this level for a relatively short period of time until the presence of the inhibitor induces the build-up of a corrosion protective coating on the metal surfaces.

Once the protective surface is established, the dosage rate needed to maintain the protection may be reduced to a normal operational range of about 100–1500 ppm without substantial sacrifice of protection.

This invention will now be further described in the following examples, which are provided for illustration purposes and are not intended to act as a limitation thereof.

EXAMPLE 1

A weight loss coupon, immersion test was used to evaluate various compounds for "naphthenic acid/sulfur corrosion". A paraffinic hydrocarbon oil was deaerated with $N_2$ purge (100 mls/min, for 30 minutes) at 100° C. The temperature was then raised to 260° C., and 10.3 mls of Kodak naphthenic acid were added. Shortly thereafter, two 1.375 in.$^2$, 1018 carbon steel (preweighed) coupons were suspended in the hot oil on glass hooks. After 18 to 20 hours of exposure (with continuous $N_2$ purge), the coupons were removed, cleaned, and reweighed.

Weight losses for untreated coupons exhibit a general corrosion rate of 103±3.0 mpy (mils per year). Table I shows the results of phosphorus and phosphorus/sulfur compounds which were evaluated under the above test conditions at 2,000 ppm active. Compound A is a calcium phosphonate-phenate sulfide, Hitec E686, and Compound B is tributylphosphate.

TABLE I

| Naphthenic Acid Corrosion Control | | |
|---|---|---|
| Compound | mpy | Solids Formed? |
| A | 47.6 ± 10.9 | No |
| B | 47.8 ± 0.8 | Yes |

Table II shows the results of varying amounts of the corrosion inhibitor of the invention consisting of tributyl phosphate, Compound B, as the representative trialkylphosphate and calcium phosphonate-phenate sulfide, Compound A, as the representative alkaline earth metal phosphonate-phenate sulfide.

TABLE II

| Naphthenic Acid Corrosion Control | | | |
|---|---|---|---|
| Inhibitor Blend | Concentration (ppm) | mpy | Solids Formed? |
| B | 500 | 30.6 ± 1.9 | No |
| A | 1500 | | |
| B | 1,000 | 33.2 ± 8.0 | No |
| A | 1,000 | | |
| B | 1,500 | 46.4 ± 0.6 | Yes |
| A | 500 | | |

EXAMPLE 2

The procedure of Example 1 was followed except that the gas used for the 18 to 20 hours continuous purge phase was 1% $H_2S$ in 99% $N_2$. Under these conditions, the blank averaged 20.4±2.1 mpy (6 data points). The results are shown in Table III.

TABLE III

| Naphthenic Acid Corrosion Control | | | |
|---|---|---|---|
| Inhibitor Blend | Concentration (ppm) | mpy | Solids Formed? |
| B | 0 | 20.5 ± 1.1 | No |
| A | 750 | | |
| B | 188 | 2.5 ± 0 | No |
| A | 562 | | |
| B | 375 | 1.8 ± 0.4 | No |
| A | 375 | | |
| B | 562 | 5.7 ± 0.3 | Yes |
| A | 188 | | |
| B | 750 | 4.1 ± 2.2 | Yes |
| A | 0 | | |

As shown above in both Examples 1 and 2, the combination of a trialkylphosphate and an alkaline earth metal phosphonate-phenate sulfide function as very efficacious naphthenic acid corrosion inhibitors. Furthermore, combinations high in the phosphonate-phenate sulfides are more efficacious in preventing undesirable solids formation than either the trialkylphosphate alone or trialkylphosphate rich mixtures.

While the illustrative embodiments of the invention have been described with particularity, it will be understood that various other modifications will be apparent to those skilled in the art without departing from the spirit and scope of the invention.

What is claimed is:

1. A process or inhibiting the corrosion of the internal metallic surfaces of the equipment used in the processing of crude oil at temperatures between 400° F. and 790° comprising adding to the crude oil a corrosion inhibiting amount of a composition comprising a trialkylphosphate containing an alkyl moiety of $C_1$–$C_{12}$ and an alkaline earth metal phosphonate-phenate sulfide in which from 20–40 percent of the phenol hydroxy groups have been phosphonated.

2. The process of claim 1 wherein the corrosion is caused by naphthenic acids present in the crude oil.

3. The process of claim 1 wherein the ratio of trialkylphosphate to alkaline earth metal phosphonate-phenate sulfide is from about 1/10 to 2/1, by weight.

4. The process of claim 3 wherein the ratio is from about 1/5 to 1/1, by weight.

5. The process of claim 1 wherein the amount of the composition added to the crude oil is an amount sufficient to generate a concentration of about 1 ppm to 5000 ppm.

6. The process of claim 5 wherein the concentration is about 100 ppm to 1500 ppm.

7. The process of claim 1 wherein the trialkylphosphate is tributylphosphate.

8. The process of claim 1 wherein the alkaline earth metal phosphonate-phenate sulfide is calcium phosphonate-phenate sulfide.

* * * * *